US007222734B2

(12) United States Patent
Barton

(10) Patent No.: US 7,222,734 B2
(45) Date of Patent: May 29, 2007

(54) WELDING WIRE PACKAGE WITH LIFTING STRAP

(75) Inventor: David J. Barton, Twinsburg, OH (US)

(73) Assignee: Lincoln Global, Inc., City of Industry, CA (US)

( * ) Notice: Subject to any disclaimer, the term of this patent is extended or adjusted under 35 U.S.C. 154(b) by 355 days.

(21) Appl. No.: 10/891,874

(22) Filed: Jul. 15, 2004

(65) Prior Publication Data

US 2006/0011503 A1 Jan. 19, 2006

(51) Int. Cl.
*B65D 85/04* (2006.01)

(52) U.S. Cl. ..... 206/389; 206/408; 206/409

(58) Field of Classification Search ..... 206/389, 206/397, 398, 409, 388, 407, 408; 242/159, 242/171, 172; 294/68.3, 68.1, 68.22, 151, 294/155, 156, 67.4
See application file for complete search history.

(56) References Cited

U.S. PATENT DOCUMENTS 1,640,368 A 8/1927 Obetz et al.
2,713,938 A 7/1955 Snyder
2,724,538 A 11/1955 Schweich
2,869,719 A 1/1959 Hubbard
2,929,496 A 3/1960 Muehlebach et al.
2,974,850 A 3/1961 Mayer
3,244,347 A 4/1966 Jenk
3,491,876 A 1/1970 Zecchin
3,933,287 A * 1/1976 Foley ..... 294/149
4,582,198 A 4/1986 Ditton
4,591,110 A 5/1986 Wirts et al.
4,623,063 A 11/1986 Balkin
4,869,367 A * 9/1989 Kawasaki et al. ..... 206/409
5,078,269 A 1/1992 Dekko et al.

(Continued)

FOREIGN PATENT DOCUMENTS

DE 20 2004 000 906 U1 4/2004

(Continued)

OTHER PUBLICATIONS

"PROSTAR Premium Quality Twist-Free Robotic Welding Wire," 2000, P-8144C 5M, 4 pages, Praxair Technology, Inc., U.S.

(Continued)

*Primary Examiner*—Mickey Yu
*Assistant Examiner*—Steven A. Reynolds
(74) *Attorney, Agent, or Firm*—Fay Sharpe LLP

(57) ABSTRACT

A package for containing a coil of wire having an outer cylindrical surface extending about a coil axis, a top and an oppositely facing bottom has a base for supporting the bottom of a wire coil when the wire coil is in the package. At least one side wall extends upwardly from the base about an outer cylindrical surface of the wire coil and has an upper edge defining a top opening in the package for removing the wire. The packaging further includes a hold-down bar between the bottom of the wire coil and the base which is transverse to the axis of the wire coil, and a lifting strap having a first end, a second end and a base portion between the first and second ends and between the bottom of the wire and the base. The base portion has an opening and the hold-down bar extends through the opening.

39 Claims, 6 Drawing Sheets

U.S. PATENT DOCUMENTS

| | | | | |
|---|---|---|---|---|
| 5,105,943 | A * | 4/1992 | Lesko et al. | 206/397 |
| 5,109,983 | A | 5/1992 | Malone et al. | |
| 5,205,412 | A | 4/1993 | Krieg | |
| 5,261,625 | A | 11/1993 | Lanoue | |
| 5,277,314 | A | 1/1994 | Cooper et al. | |
| 5,374,005 | A | 12/1994 | Jenkins et al. | |
| 5,494,160 | A | 2/1996 | Gelmetti | |
| 5,553,810 | A | 9/1996 | Bobeczko | |
| 5,746,380 | A * | 5/1998 | Chung | 242/171 |
| 5,816,466 | A | 10/1998 | Seufer | |
| 5,819,934 | A * | 10/1998 | Cooper | 206/397 |
| 5,845,862 | A | 12/1998 | Cipriani | |
| 6,237,768 | B1 * | 5/2001 | Cipriani | 206/408 |
| 6,648,141 | B2 | 11/2003 | Land | |
| 6,715,608 | B1 * | 4/2004 | Moore | 206/397 |
| 6,745,899 | B1 | 6/2004 | Barton | |
| 2001/0006184 | A1 * | 7/2001 | Ohike et al. | 228/33 |
| 2003/0019776 | A1 | 1/2003 | Matsuguchi et al. | |

FOREIGN PATENT DOCUMENTS

| | | |
|---|---|---|
| EP | 1 057 751 A1 | 6/2000 |
| GB | 2 092 110 A | 8/1982 |
| JP | 62-111872 | 5/1987 |
| WO | 94/00493 | 9/1994 |
| WO | WO 98/52844 | 11/1998 |

OTHER PUBLICATIONS

"Weld Point robotic welding wire, Technology of the Future," 1997, 10 pages, Microline Networks s.r.l., Italy.

LeCube, "The Squaring of the Circle," date unknown, 8 pages, C.I.F.E. spa, Italy.

* cited by examiner

WELDING WIRE PACKAGE WITH LIFTING STRAP

The present invention relates to welding wire packaging and more particularly to a welding wire package with an improved lifting strap configuration that cannot be easily removed until the welding wire is consumed.

INCORPORATION BY REFERENCE

Welding wire used in high production operations, such as robotic welding stations, is provided in a package generally having over 200 pounds of wire. The package is often a drum where a large volume of welding wire is looped in the drum around a central core or a central clearance bore. During transportation a hold down mechanism can be used to prevent the wire coil from shifting. To control the transportation and payout of the wire, it is standard practice to provide an upper retainer ring which can be utilized as a part of the hold down mechanism to prevent wire shifting. One such package is shown in Cooper U.S. Pat. No. 5,819,934 which is incorporated by reference herein as background material showing the same. Another such packaging is shown in Kawasaki U.S. Pat. No. 4,869,367 which is also incorporated by reference herein for showing welding wire packages utilizing hold down mechanisms. Cipriani U.S. Pat. No. 6,481,575 shows a welding wire package which utilizes a packing skid and is also incorporated by reference for showing the same. Jenkins U.S. Pat. No. 5,374,005 shows a wire package which utilizes handles and is also incorporated by reference for showing the same.

BACKGROUND OF INVENTION

In the welding industry, a tremendous number of robotic welding stations are each operable to draw welding wire from a package to provide a continuous supply of wire to perform successive welding operations. The advent of this mass use of electric welding wire has created a need for large packages for containing and dispensing large quantities of welding wire. A common package is a drum where looped or coiled welding wire is deposited in the drum as a wire stack, or body, of wire having a top surface with an outer cylindrical surface against the drum and an inner cylindrical surface defining a central bore. The central bore is often occupied by a cardboard cylindrical core as shown in Cooper U.S. Pat. No. 5,819,934. It is common practice for the drum to have an upper retainer ring that is used in transportation to stabilize the body of welding wire as it settles. This ring, as is shown in Cooper, remains on the top of the welding wire to push downward by its weight so the wire can be pulled from the body of wire between the core and the ring. In addition, a hold-down mechanism can be utilized to increase the downward force. As can be appreciated, large welding wire packages are heavy and require the use of lifts and other material transport devices to move the packages. As can also be appreciated, the wire packages may be moved several times before the wire is consumed. This can include several moves between the wire manufacturer and the end user and even several moves once the package reaches the end user. Therefore, it is advantageous to include a mechanism on the packaging to facilitate the use of lifting equipment to move the packaging.

Some prior art packages include handles on their outer surfaces to help grasp the container. However, handles provide little benefit for larger wire packages.

Other prior art welding wire packages include a built in packing skid or pallet to allow a fork lift to move the wire packaging. As can be appreciated, the packing skid which is heavy and bulky, and often expensive, must be disposed of once the welding wire is consumed. In view of the high volumes of welding wire used during many welding operations, especially robotic welding operations, there is a need for a wire package that is easily and economically disposable.

In order to overcome the shortcomings of packing skids, others have utilized lifting straps to lift the heavy wire packages. These lifting straps have loops on either end and the straps extend into the packaging and wrap around the base of the wire coil. The loops are utilized to attach the packaging to a lifting device. However, if only one loop is pulled, the strap can be pulled from the packaging. As can be appreciated, once the strap has been pulled from the packaging, it is difficult, if not impossible, to utilize the strap to lift the welding wire package. Further, if the strap is securely affixed to the packaging, such as by staples, it is difficult to separate the strap from the packaging after the wire is consumed. As can be appreciated, in order to recycle the packing materials, it is advantageous to be able to easily separate unlike materials, such as separating paper products of the package from the materials used to make the strap.

STATEMENT OF INVENTION

In accordance with the present invention, a welding wire package is provided which includes a lifting strap that cannot be pulled from the packaging but which is also easily separable from the packaging after the welding wire is consumed. In this respect, a package according to the present invention includes a lifting strap which interengages with the hold-down mechanism of the wire package to prevent removal of the strap until the welding wire is consumed.

An object of the present invention is the provision of a welding wire package which includes a lifting strap that cannot be inadvertently removed from the package until the welding wire has been consumed.

A further object of the present invention is the provision of welding wire package which includes a lifting strap that prevents removal of the strap before the welding wire has been consumed.

Still a further object of the present invention is the provision of a welding wire package which includes a lifting strap that can be easily separated from the remaining package components after the welding wire has been consumed.

Another object of the present invention is the provision of a welding wire package which includes a lifting strap that can be used to transport the package.

Yet another object of the present invention is the provision of a welding wire package which includes a lifting strap that is economical to produce, easy to use and either reuse or discard after use.

BRIEF DESCRIPTION OF DRAWINGS

The foregoing objects, and others, will in part be obvious and in part pointed out more fully hereinafter in conjunction with a written description of preferred embodiments of the present invention illustrated in the accompanying drawings in which.

DESCRIPTION OF PREFERRED EMBODIMENTS

Figure 1:
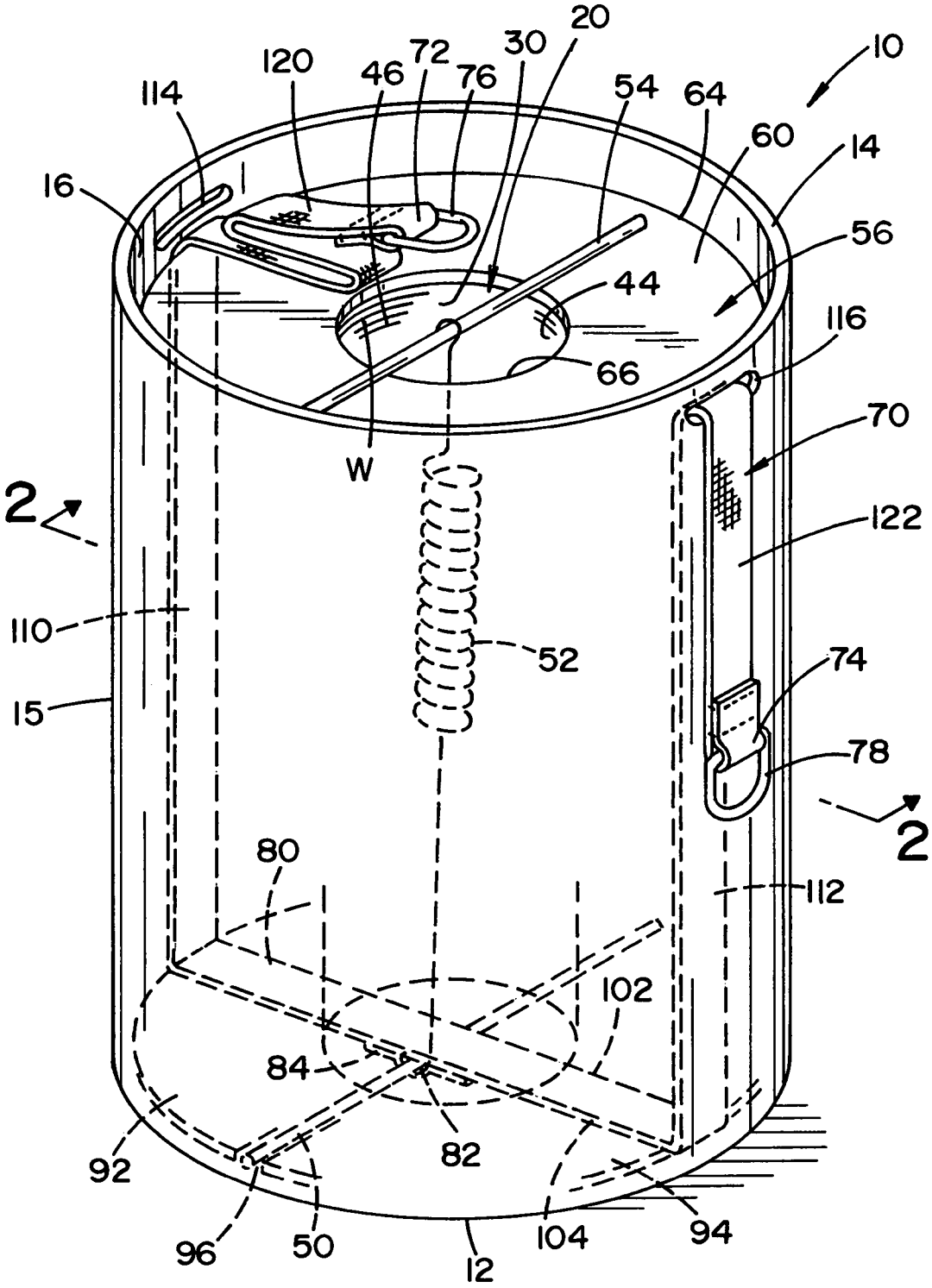
FIG. 1 is a perspective view of a welding wire package according to the present invention with a lifting strap in a non-lifting condition.
Figure 2:
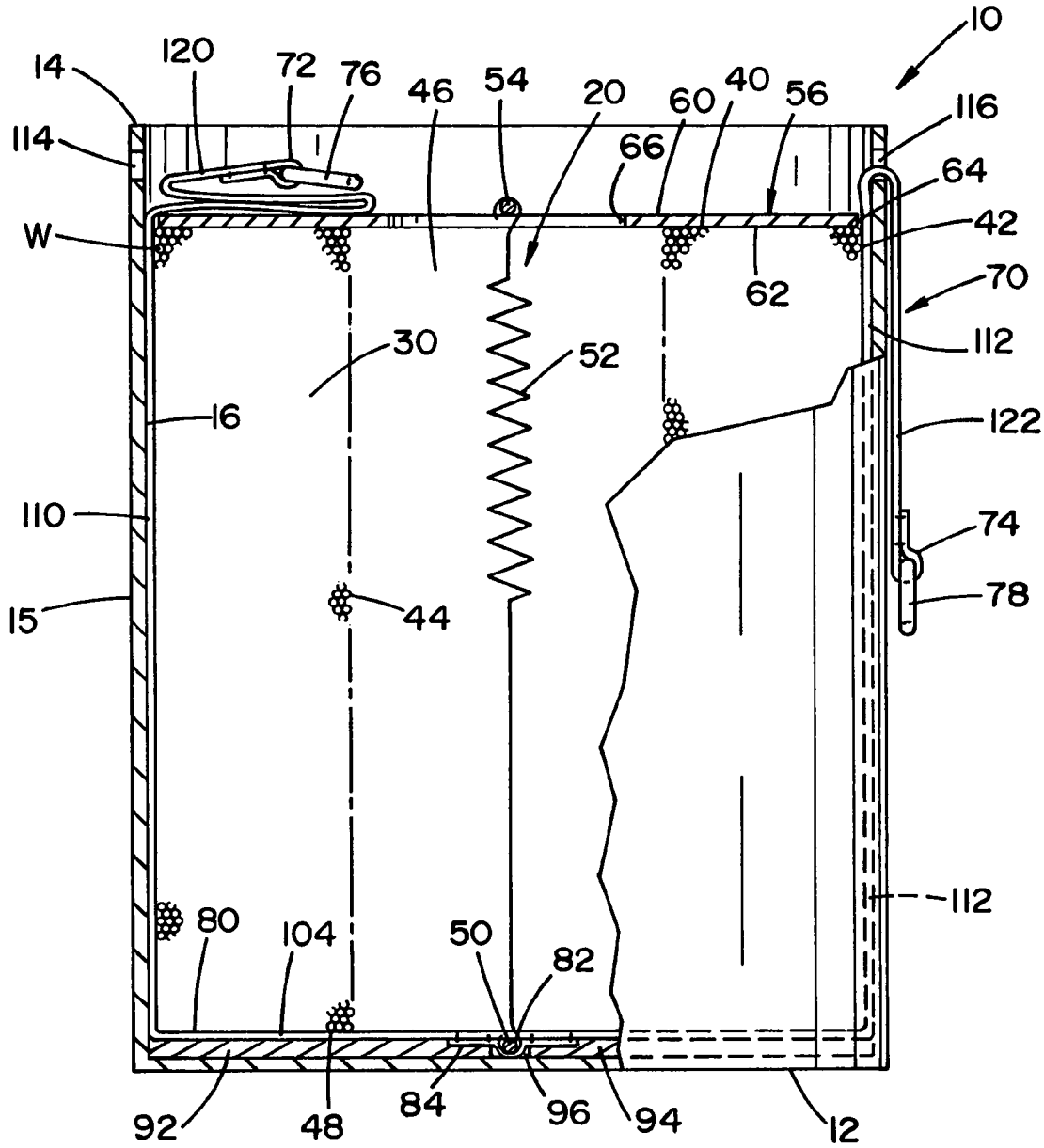
FIG. 2 is a cross-sectional elevation view taken along line 2-2 of FIG. 1.
Figure 3:
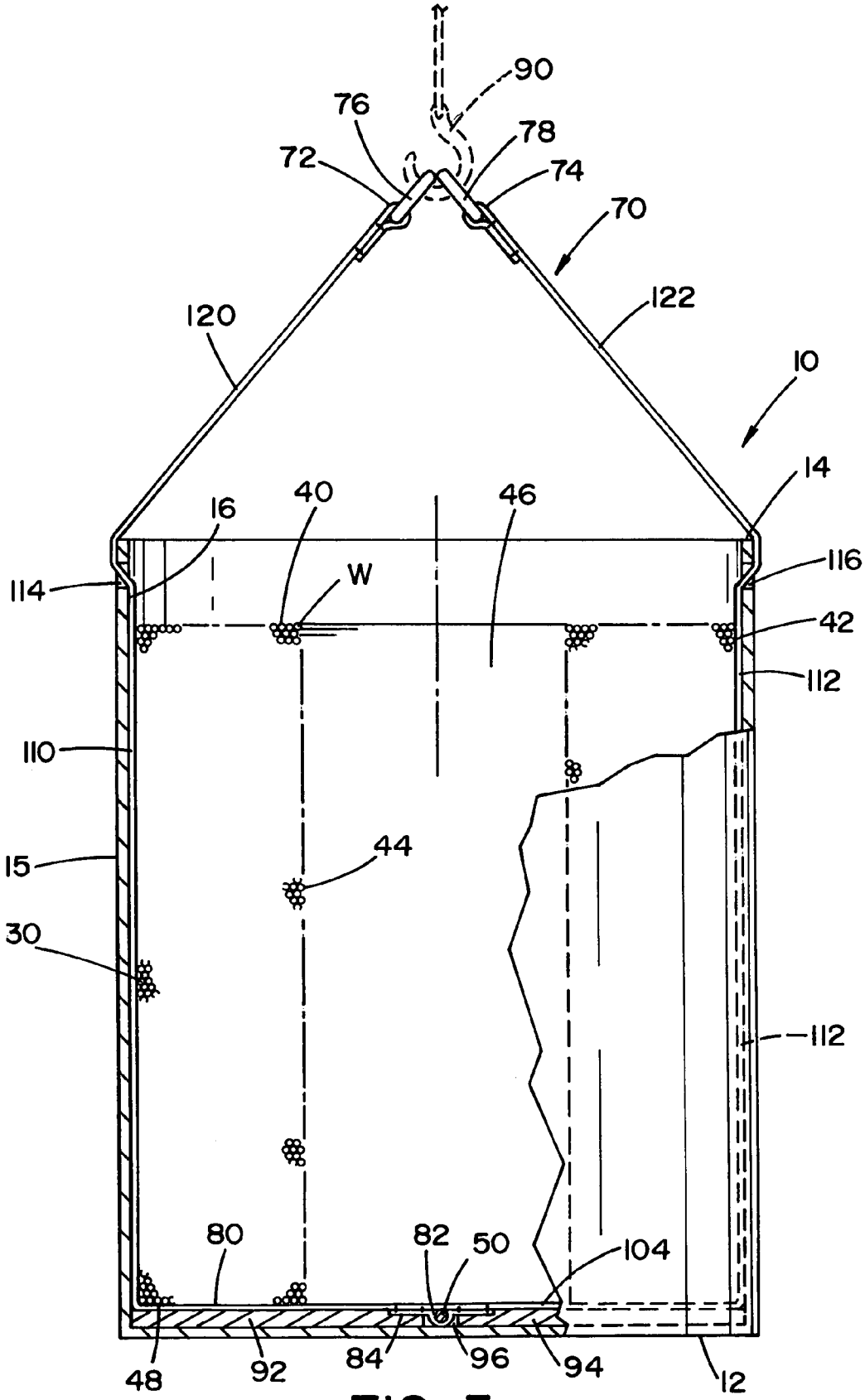
FIG. 3 is a cross-sectional elevation view as is shown in FIG. 2 with the lifting strap in a lifting condition.
Figure 4:
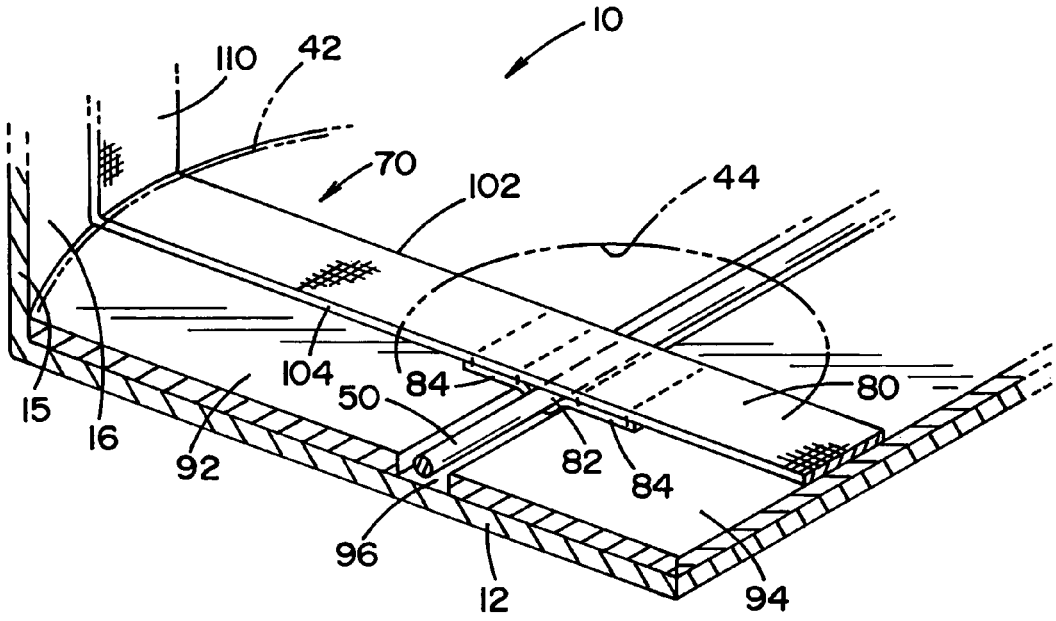
FIG. 4 is an enlarged perspective sectional view of the base area of the package shown in FIG. 1.

Referring now in greater detail to the drawing wherein the showings are for the purpose of illustrating preferred embodiments of the invention only, and not for the purpose of limiting the invention, FIGS. 1-4 illustrate a welding wire drum type package 10 wherein a wire W is stored in and paid out of the package which includes a bottom 12, a top 14, and a cylindrical side wall 15 having an inner surface 16. Package 10 can further include a cylindrical cardboard core (not shown) concentric with surface 16. Package 10 further includes a hold-down mechanism 20 which helps maintain a coil 30 of wire W and prevents coil 30 from shifting during transportation.

As is know, package 10 is loaded with wire W at the wire manufacturing facility and the wire is looped into the package to define a body of welding wire, namely, wire coil 30 having a top surface 40, an outer cylindrical surface 42 against surface 16 and an inner cylindrical surface 44. In this manner, a central vertically extending bore 46 is formed which is concentric with surface 16. Again, in some instances, an inner core (not shown) can be used. The coil further includes a bottom surface 48 which can rest against package bottom 12 which will be discussed in greater detail below. The wire is looped in a manner such that it has a cast to facilitate payout with a minimum of tangles. This produces an upward springing effect which must be controlled during both the transport of packaging 10 and during the unwinding of the welding wire. During the transport of the package the upward springing, and generally the prevention of wire shifting in the coil, is managed by hold-down mechanism 20.

Hold-down mechanism 20 includes a hold-down bar 50, a force producing member 52 and a top bar 54. As is stated above, the hold-down mechanism prevents the shifting and/or upward springing of the wire in the wire coil during transport. This is accomplished by producing a downward force on top surface 40 of coil 30. More particularly, hold down bar 50 is maintained relative to bottom 12 of the package. Bar 50 can be any known hold-down bar including, but not limited to, a straight elongated bar, a curved bar (not shown) or a hook (not shown). Further, based on all intended uses of bar 50, the bar is made from a suitable material such as, but not limited to, metal. Depending on the type of bar utilized, the bar is secured relative to the bottom of the package. In the case of a straight hold down bar, the bar can be positioned between coil bottom 48 and bottom 12 of package 10. The weight of coil 30 prevents upward movement of the bar. However, hold down bar 50 can also be fastened to wall 15 and/or bottom 12. Force member 52 is attached between hold-down bar 50 and top bar 54 such that member 52 produces a downward force in top bar 54. Member 52 can be any know force producing member including, but not limited to, an elastic band or a spring, as shown.

Hold-down mechanism 20 can further include a ring 56 on top surface 40 of the coil to produce an even downward force on the coil. Ring 56 can be a retainer ring which is also used to prevent tangles in wire W as the wire is unwound from wire coil 30. As is known in the art, package 10 can further include a ring protection member (not shown) which extends between top bar 54 and ring 56. In this respect, if ring 56 is a retainer ring, it is typically configured for maximum functionality for the controlling of the unwinding of the wire and is not optimally designed for the transport of the package. As is shown, ring 56 has a top surface 60 and a bottom surface 62 wherein bottom surface 62 engages coil top 40. Top bar 54 engages top ring surface 60 to produce the downward force on ring 56. Ring 56 further includes an outer periphery 64 having a diameter less than that of inner surface 16 of wall 15 and an inner periphery 66. As is shown, outer periphery 64 can be spaced slightly inward of surface 16. Further, ring 56 can be any known ring in the art and/or can be a ring design for transporting only.

Package 10 further includes a lift strap 70 having a first end 72 and a second end 74. First and seconds ends 72 and 74 include loops or rings 76 and 78, respectively. Loops 76 and 78 can be of any configuration and constructed of any suitable material including, but not limited to, metal, and can be loops created integrally by the material of strap 70. Loops 76 and 78 are used to attach strap 70 to a lifting device 90 that can also be any known device in the art. Strap 70 has a middle section or bottom 80 between ends 72 and 74 that is positioned between bottom 12 and coil bottom 48. As will be appreciated, the majority of the weight of package 10 is from coil 30. Therefore, by extending below the coil, the strap can support the weight of the package without being attached to the outer packaging. Strap 70 is provided with a strap securing hole 82 in bottom section 80 for securing the strap to hold-down bar 50. In this respect, hold-down bar 50 extends through strap hole 82 such that strap 70 cannot be removed from package 10 without dislodging bar 50. While it is preferred that an existing structure, such as mechanism 20, be used to secure strap 70, bar 50 can be an independent component with its primary function being to secure strap 70.

In one embodiment (FIG. 4), strap hole 82 is produced by a strap section 84 attached to strap 70 at strap bottom 80 by any known means. This can include, but is not limited to, sewing strap section 84 to strap 70. By including section 84 which extends generally parallel to bottom 80, hole 82 is substantially parallel to the strap faces of strap 70. As a result, bar 50 can extend through hole 82 without twisting or distorting the strap. In another embodiment, package 10 can further include inserts or flaps 92 and 94 that are smaller than bottom 12 such that they produce a flap recess 96. Flap recess 96 is large enough to a least partially receive bar 50. By having recess 96, bar 50 is more difficult to dislodge and has less bending affect on coil 30 at the points in which bar 50 extends under the coil.

Figure 5:
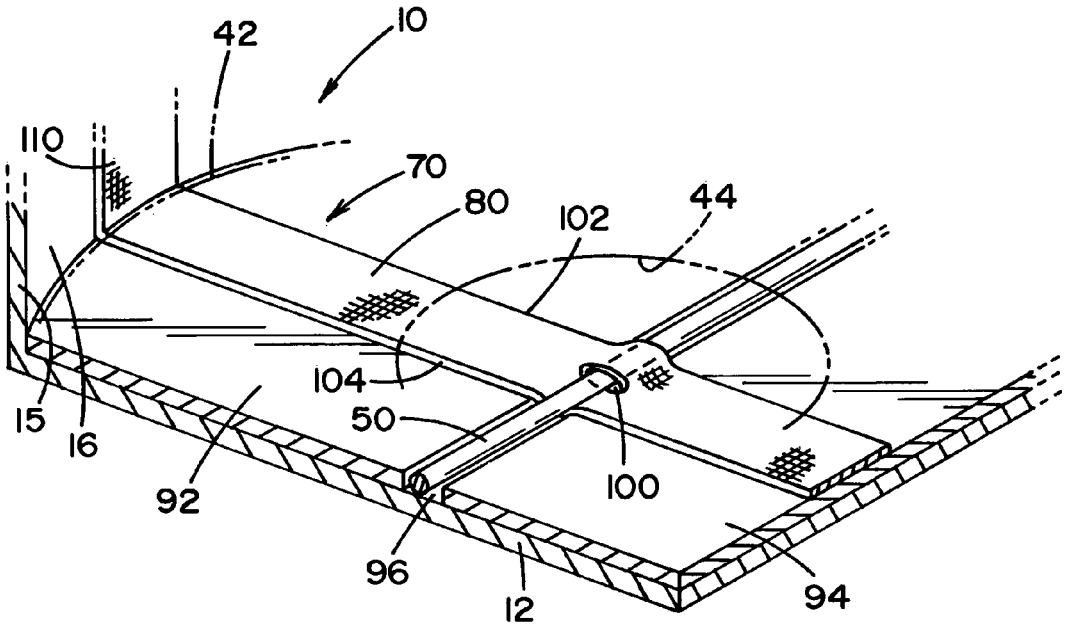
FIG. 5 is an enlarged perspective sectional view of the base area of another embodiment of the present invention.

In yet another embodiment (FIG. 5), strap section 80 has a strap securing hole 100 integral therewith between strap edges 102 and 104. Hole 100 can be cut into strap bottom 80 or can be sewn into the strap section or can be produced in any known manner in the art. As will be appreciated, while only two arrangements for providing strap holes are shown, other arrangements for providing strap holes, and/or other methods of securing strap 70 to bar 50, and/or another component of mechanism 20 can be utilized without detracting from the invention.

Strap 70 further includes upward extending portions 110 and 112 which extend upwardly from either side of bottom 80. In this embodiment, portions 110 and 112 extend between outer coil surface 42 and inner carton surface 16. However, while not shown, package 10 can further include a liner and/or a vapor barrier extending around coil 30 and can include other packaging material(s) known in the art. In order to better stabilize the lifting of package 10, the package further includes diametrically opposite strap openings 114 and 116 in side wall 15 near top 14. The strap openings are shaped to allow strap 70 to pass through side wall 15. Outer sections 120 and 122 of strap 70 extend from openings 114 and 116, respectively, to strap ends 72 and 74. As can be seen best in FIG. 3, by passing strap 70 through strap openings 114 and 116, the position of strap bottom 80, and strap sections 110 and 112, are substantially maintained regardless of the direction of the lifting forces produced by lifting device 90. In addition, lifting stability is increased by at least partially controlling the lifting at a point at or near top 14 of package 10.

In the following discussions concerning yet further embodiments of the present invention, the components of the wire package which remain the same as those discussed above are identified by the same reference numbers.

Figure 6:
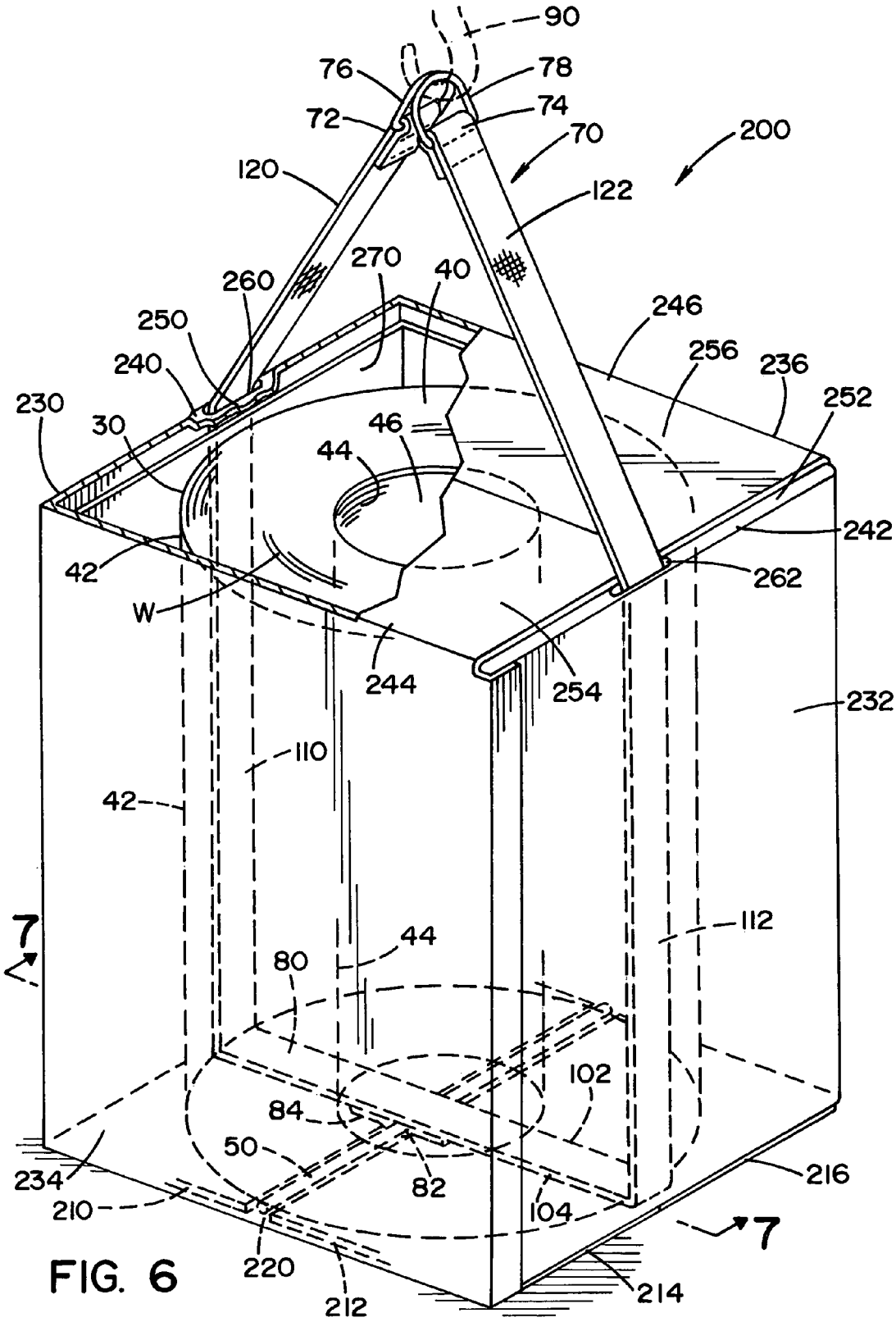
FIG. 6 is a perspective view of yet another embodiment of a welding wire package according to the present invention with a lifting strap in the lifting condition; and, FIG. 7 is a cross-sectional elevation view taken along line 7-7 of FIG. 6.
Figure 7:
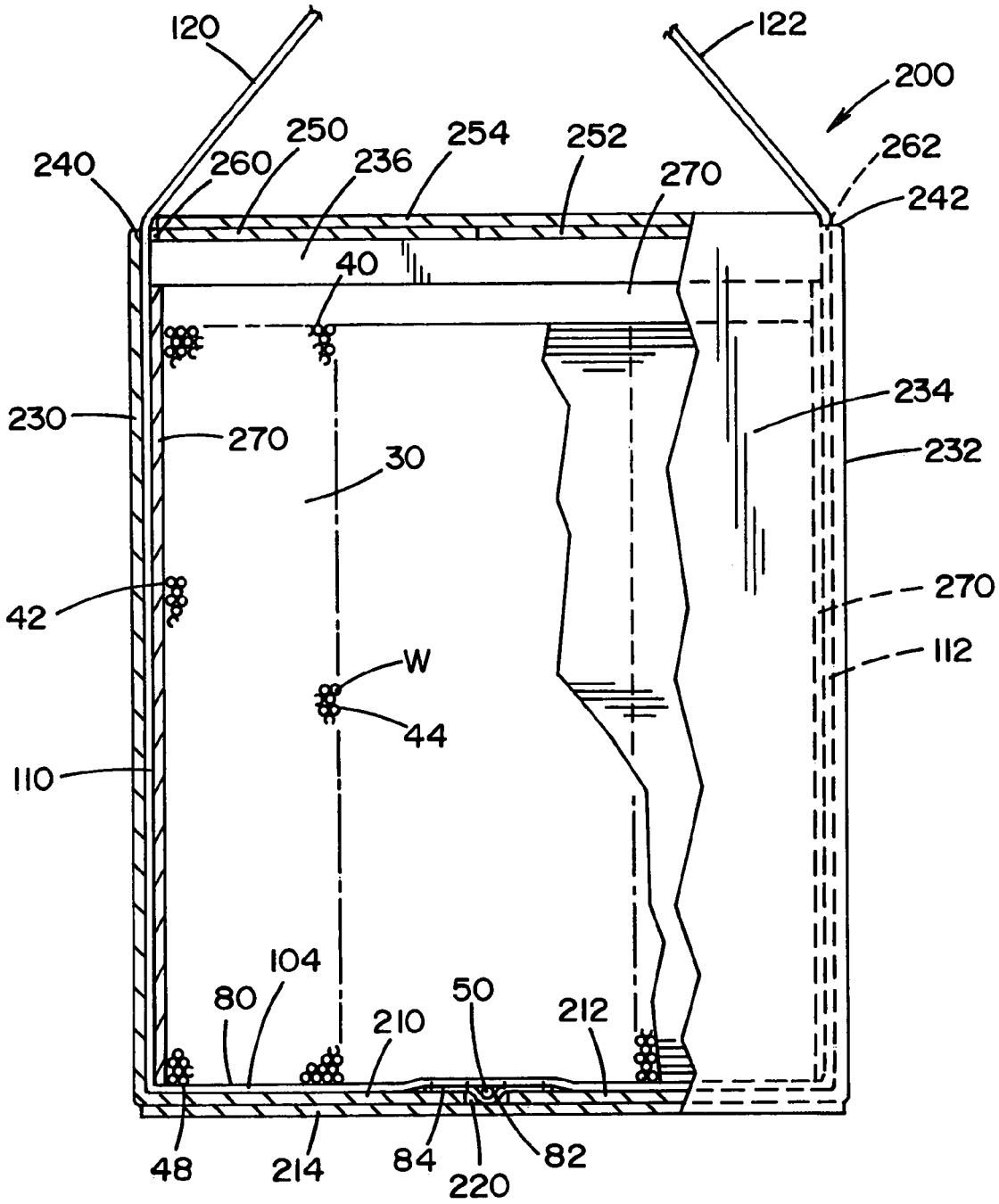

With reference to FIGS. 6 and 7, welding wire package 200 is shown. As will be appreciated from these figures, welding wire strap 70 can be used with a wide range of welding wire packages known in the art including square box packages such as welding wire package 200. In addition, while not shown, package 200 can include a hold-down mechanism such as hold-down mechanism 20. In this respect, if a hold down mechanism is not desired or a different style is used, bar 50 in any embodiment can be used only for strap 70 such that it does not have a secondary function. As is shown, package 200 includes bar 50 positioned below coil bottom 48. Essentially, strap 70 is as discussed above and, therefore, will not be discussed in detail with respect to package 200. However, due to the square design of this packaging, package 200 can include rectangular inner bottom flaps 210 and 212 and outer bottom flaps 214 and 216. In order to produce a flap recess 220 for at least partially receiving bar 50, inner flaps 210 and 212 can be shortened. As stated above, by including flap recess 220, bar 50 has less of a distorting affect on coil 30. Further, recess 220 makes it more difficult to dislodge bar 50 and, therefore, strap is better secured to package 200 without the need to fasten the strap to the package. As with package 10, strap 70 can utilize a wide range of arrangements for providing holes to allow bar 50 to pass through strap 70 and maintain the strap relative to the bar until the wire is consumed.

Package 200 includes side walls 230 and 232 which extend upwardly from inner flaps 210 and 212, respectively, and side walls 234 and 236 which extend upwardly from outer flaps 214 and 216. However, it will be appreciated, that walls 230 and 232 can extend from the outer bottom flaps and walls 234 and 236 can extend from the inner bottom flaps. Side wall 230 extends to a top edge 240, Side wall 232 extends to a top edge 242, Side wall 234 extends to a top edge 244 and Side wall 236 extends to a top edge 246. Package 200 further includes inner top flaps 250 and 252 extending respectively from side walls 230 and 232, and outer flaps 254 and 256 extending respectively from side walls 234 and 236. Again, while not shown, the inner and outer top flaps can be attached to any of the side walls of package 200.

Package 200 further includes openings 260 and 262 at or near top edges 240 and 242, respectively. As discussed above with package 10, openings 260 and 262 are large enough to allow strap 70 to pass from the inside of package 200 to the outside. Similar to package 10, this configuration increases the stability of package 200 when being lifted by lifting device 90. As will be appreciated, openings similar to openings 260 and 262 can also be provided at or near top edges 244 and 246 of sides 234 and 236, thus providing selectively for the position of the coil and strap in the box.

While only a few package configurations are shown, the invention of this application can be used with a wide range of welding wire packages and package accessories known in the art. The accessories include, but are not limited to, a package liner 270 between the side wall(s) and outer surface 42 of coil and, while not shown, vapor barriers, corner supports for the other hold-down mechanisms, and a wide range of retainer rings.

While considerable emphasis has been placed on the preferred embodiments of the invention illustrated and described herein, it will be appreciated that other embodiments can be made and that many changes can be made in the preferred embodiments without departing from the principals of the invention. Accordingly, it is to be distinctly understood that the foregoing descriptive matter is to be interpreted merely as illustrative of the invention and not as a limitation and that it is intended to include other embodiments and all modifications of the preferred embodiments insofar as they come within the scope of the appended claims or the equivalents thereof.

Having thus defined the invention, the following is claimed:

1. A package for containing a coil of wire having a coil axis, a top and a bottom; said package comprising: a base supporting an associated wire coil in said package with the axis of the coil extending upwardly of said base; wall means extending upwardly from said base and having an upper edge defining a top opening for said package, a bar at said base transverse to said wall means; and a lifting strap having a first end, a second end and a base portion between said first and second ends, said base portion having an opening, and said bar extending through said opening, a portion of said bar being between the bottom of the associated wire coil and said base.

2. The package of claim 1, wherein said base includes a pair of inner flaps and a pair of outer flaps, said inner flaps having flap ends which face one another and which are spaced from one another forming a flap recess, said bar being at least partially in said flap recess.

3. The package of claim 1, wherein said wall means comprises four side walls including a first and a second side wall having a first and a second upper edge, respectively, said package further including a pair of top flaps extending from said first and second upper edges, a first opening near said first upper edge and a second opening near said second upper edge, and said first and second ends of said lifting strap respectively passing through said first and second openings.

4. The package of claim 3, wherein said pair of top flaps includes a first top flap and a second top flap, said first opening being between said first flap and said first side wall and said second opening being between said second flap and said second side wall.

5. The package of claim 3, further including an inner liner adjacent said four side walls, said lifting strap extending between said liner and said first and second side walls.

6. The package of claim 1, wherein said bar is a straight bar.

7. The package of claim 1, further including an inner liner adjacent said wall means, and said lifting strap extending between said liner and said wall means.

8. The package of claim 7, further including a hold-down mechanism, and said bar being part of said hold-down mechanism.

9. The package of claim 1, further including a hold-down mechanism, and said bar being part of said hold-down mechanism.

10. The package of claim 1, further including a hold-down mechanism, and said bar being separate from said hold-down mechanism.

11. The package of claim 1, wherein said base portion of said lifting strap has strap edges, a bottom face and a top face, said top and bottom faces extending between said strap edges, said lifting strap further including a secondary strap joined to said bottom face of said base portion, said opening being a spacing between said bottom face of said based portion and said secondary strap, and said bar passing below said base portion.

12. The package of claim 1, wherein said bar is an elongate rod.

13. The package of claim 1, wherein said bar is metal.

14. The package of claim 1, wherein said bar is spaced from said wall means.

15. The package of claim 1, wherein said bar is secured in said package by the engagement between said bar, said base and the bottom of the associated wire coil in the package.

16. The package of claim 1, wherein said lifting strap has a length such that said first and second ends can extend vertically above said top opening.

17. The package of claim 1, wherein said wall means includes a cylindrical side wall.

18. The package of claim 17, wherein said base portion of said lifting strap has strap edges and oppositely facing strap faces extending between said strap edges, said opening being in said strap between said faces and said side edges.

19. The package of claim 17, wherein said base portion of said lifting strap has strap edges and oppositely facing strap faces extending between said strap edges, said lifting strap further including a secondary strap joined to said base portion, said opening being a spacing between said based portion and said secondary strap.

20. The package of claim 19, further including base inserts on said base of said package, said base inserts being spaced from one another thereby forming a recess, said bar being at least partially in said recess.

21. A package for containing a coil of wire having a coil axis, a top and a bottom; said package comprising: a base supporting an associated wire coil in said package with the axis of the coil extending upwardly of said base; wall means extending upwardly from said base and having an upper edge defining a top opening for said package, a bar at said base transverse to said wall means; and a lifting strap having a first end, a second end and a base portion between said first and second ends, said base portion having an opening, and said bar extending through said opening, said base portion of said lifting strap has strap edges and oppositely facing strap faces extending between said strap edges, said opening being in said strap between said faces and side edges.

22. The package of claim 21, wherein said base includes a pair of inner flaps and a pair of outer flaps, said inner flaps having flap ends which face one another and which are spaced from one another forming a flap recess, said bar being at least partially in said flap recess.

23. The package of claim 21, wherein said wall means comprises four side walls including a first and a second side wall having a first and a second upper edge, respectively, said package further including a pair of top flaps extending from said first and second upper edges, and said first and second ends of said lifting strap respectively passing through said first and second openings.

24. The package of claim 23, wherein said pair of top flaps includes a first top flap and a second top flap, said first opening being between said first flap and said first side wall and said second opening being between said second flap and said second side wall.

25. The package of claim 23, further including an inner liner adjacent said four side walls, said lifting strap extending between said liner and said first and second side walls.

26. A package for containing a coil of wire having a coil axis, a top and a bottom; said package comprising: a base supporting an associated wire coil in said package with the axis of the coil extending upwardly of said base; wall means extending upwardly from said base and having an upper edge defining a top opening for said package, a bar at said base transverse to said wall means; and a lifting strap having a first end, a second end and a base portion between said first and second ends, said base portion having an opening, and said bar extending through said opening, said base portion of said lifting strap has strap edges and oppositely facing strap faces extending between said strap edges, said lifting strap further including a secondary strap joined to said base portion, said opening being a spacing between said based portion and said secondary strap.

27. The package of claim 26, wherein said base includes a pair of inner flaps and a pair of outer flaps, said inner flaps having flap ends which face one another and which are spaced from one another forming a flap recess, said bar being at least partially in said flap recess.

28. The package of claim 26, wherein said wall means comprises four side walls including a first and a second side wall having a first and a second upper edge, respectively, said package further including a pair of top flaps extending from said first and second upper edges, a first opening near said first upper edge and a second opening near said second upper edge, and said first and second ends of said lifting strap respectively passing through said first and second openings.

29. The package of claim 28, wherein said pair of top flaps includes a first top flap and a second top flap, said first opening being between said first flap and said first side wall and said second opening being between said second flap and said second side wall.

30. The package of claim 28, further including an inner liner adjacent said four side walls, said lifting strap extending between said liner and said first and second side walls.

31. The package of claim 26, wherein said secondary strap is sewn to said base portion.

32. The package of claim 26, wherein said secondary strap has a cross-sectional configuration similar to a cross-sectional configuration of said lifting strap.

33. The package of claim 26, wherein said bar is a straight elongated bar.

34. A package for containing a coil of wire having a coil axis, a top and a bottom; said package comprising: a base supporting an associated wire coil in said package; wall means extending upwardly from said base, said wall means having an upper edge defining a top opening for said package; a bar at said base transverse to said wall means; and a lifting strap having a first end and a second end and a bar connector between said first and second ends, said strap being selectively connectable to said bar at said connector, a portion of said bar being between the bottom of the associated wire coil and said base.

35. The package of claim 34, wherein said base includes a pair of inner flaps and a pair of outer flaps, said inner flaps having flap ends which face one another and which are spaced from one another forming a flap recess, said bar being at least partially in said flap recess.

36. The package of claim 34, wherein said lifting strap has strap edges and oppositely facing strap faces extending between said strap edges, said bar connector being an opening in said strap between said faces and said side edges.

37. The package of claim 34, wherein said lifting strap has strap edges and oppositely facing strap faces extending between said strap edges, said lifting strap further including a secondary strap joined to said lifting strap, said bar connector being an opening provided by a spacing between said lifting strap and said secondary strap.

38. The package of claim 37, wherein said secondary strap is below said lifting strap.

39. A package containing a coil of wire having a coil axis, a top and a bottom; said package comprising: a base supporting an associated wire coil in said package with the coil axis extending upwardly of the base; wall means extending upwardly from said base and having an upper edge defining a top opening in said package for removing the wire; a hold-down mechanism; and a lifting strap having a first end, a second end and a base portion between said first and second ends, at least a portion of said base portion being between said base and the bottom of the associated wire coil, said portion being selectively interengageable with said hold-down mechanism.

* * * * *